United States Patent [19]

Bull et al.

[11] Patent Number: 4,829,723

[45] Date of Patent: May 16, 1989

[54] RAIL GRINDING MACHINE

[75] Inventors: Timothy B. H. Bull, Annandale; Alan L. Dzubak, Minneapolis; Darwin H. Isdahl, Plymouth, all of Minn.

[73] Assignee: Loram Maintenance of Way, Inc., Hamel, Minn.

[21] Appl. No.: 109,542

[22] Filed: Oct. 16, 1987

[51] Int. Cl.[4] ..... E01B 3/17

[52] U.S. Cl. ..... 51/178; 51/165.71; 51/281 R

[58] Field of Search ..... 51/178, 165.71, 281 R

[56] References Cited

U.S. PATENT DOCUMENTS

| | | | |
|---|---|---|---|
| 2,741,883 | 4/1956 | Scheuchzer et al. | 51/178 |
| 3,358,406 | 12/1967 | Speno, Jr. et al. . | |
| 3,423,858 | 1/1969 | Speno . | |
| 3,526,997 | 9/1970 | Panetti . | |
| 3,606,705 | 9/1971 | Rivoire . | |
| 3,707,808 | 1/1973 | Danko et al. . | |
| 3,888,052 | 6/1975 | Panetti . | |
| 4,091,578 | 5/1978 | Panetti | 51/178 |
| 4,115,857 | 9/1978 | Panetti . | |
| 4,189,873 | 2/1980 | Panetti . | |
| 4,492,059 | 1/1985 | Panetti . | |
| 4,583,327 | 4/1986 | Jaeggi . | |
| 4,583,895 | 4/1986 | Theurer . | |
| 4,584,798 | 4/1986 | Rivoire . | |
| 4,596,092 | 6/1986 | Panetti . | |
| 4,615,150 | 10/1986 | Panetti . | |
| 4,622,781 | 11/1986 | Vieau et al. . | |

FOREIGN PATENT DOCUMENTS

| | | | |
|---|---|---|---|
| 616186 | 3/1980 | Switzerland | 51/178 |

OTHER PUBLICATIONS

Article entitled "Computerized Switch Grinder", from *Progressive Railroading*, Jul. 1986, p. 50.

*Primary Examiner*—Roscoe V. Parker

*Attorney, Agent, or Firm*—Dorsey & Whitney

[57] ABSTRACT

A rail grinding machine especially designed for grinding railroad track rails at railroad track switches and road crossings. The grinding machine includes an articulated grinding module supporting undercarriage suspended from the grinding machine main frame. The undercarriage includes a unique suspension system that allows for lateral shifting and pivoting of the undercarriage independently of the grinding machine main frame. Grinding operations are controlled by sensing the supply pressure of the constant flow hydraulic fluid used to power the individual grinding modules, and positioning the grinding modules in grinding abutment with the rails as a function of the supply pressure.

41 Claims, 11 Drawing Sheets

20
30
22
24
32
34
34 W
38
P
28
102b
158
102
114
36
50
44
54
102a
104
106
58b
100
148
138
48
42
52
40
58a
26
46

RAIL GRINDING MACHINE

TECHNICAL FIELD

This invention relates to machines for maintaining the surfaces of railroad track rails. In particular, it relates to a rail grinding machine especially adapted for grinding rails at railroad track switches and road crossings.

BACKGROUND ART

Railroad track rails are subject to wear by the passage of trains over the rails. In particular, depressions in the upper surface of a rail may develop such that the railhead presents an undulating, corrugated surface. Moreover, the rail may develop burrs, or otherwise lose its symmetrical profile. Maintenance of smooth running surfaces on railroad track rails is important for reasons of safety, riding comfort, protection of the track, track bed and rolling stock, noise suppression, and reduced maintenance of the track and track bed.

Railroad switches and road crossings present particular problems to the rail grinding process. Gaps are necessarily presented in the railroad switches to permit the wheels of a railroad car to cross over one or the other of a set of rails in the switch, and at least one of the sets of rails in a switch will be curved. An additional problem presented at road crossings as well as at railroad switches, is the presence of obstructions close to the railhead. In short, rail grinding is a demanding, precise process, that even on straight, unobstructed, main line track is technically challenging, and which is particularly difficult at track intersections and road crossings.

The length of track sections at railroad switches and road crossings is typically short. Nevertheless, undulations in the rail surfaces of switches and crossings can impart vibratory motion to rolling stock, that will continue long after the train has passed by the switch or crossing. A railroad grinding machine particularly adapted for grinding the surfaces of railroad track rails at railroad switches and road crossings would accordingly be a decided advantage.

SUMMARY OF THE INVENTION

The rail grinding machine in accordance with the present invention is particularly adapted for grinding rail surfaces at railroad track switches and road crossings. A self-propelled, rail mounted main frame includes an articulated, independently rail supported undercarriage. The undercarriage includes a plurality of independently movable grinding modules. Motive force is presented to the undercarriage from the main carriage through a unique slide and bracket assembly that transmits motive power to the undercarriage without interfering with the independent suspension of the undercarriage. A unique grinding control system allows for the precise positioning of the grinding modules along the railhead to be ground, notwithstanding the presence of obstructions or gaps at the railhead. The articulated undercarriage, unique suspension, and grinding control system provide the rail grinding machine hereof with the ability to effectively grind the rails of a switch or railroad crossing.

DETAILED DESCRIPTION OF THE DRAWINGS

Figures 1, 2:
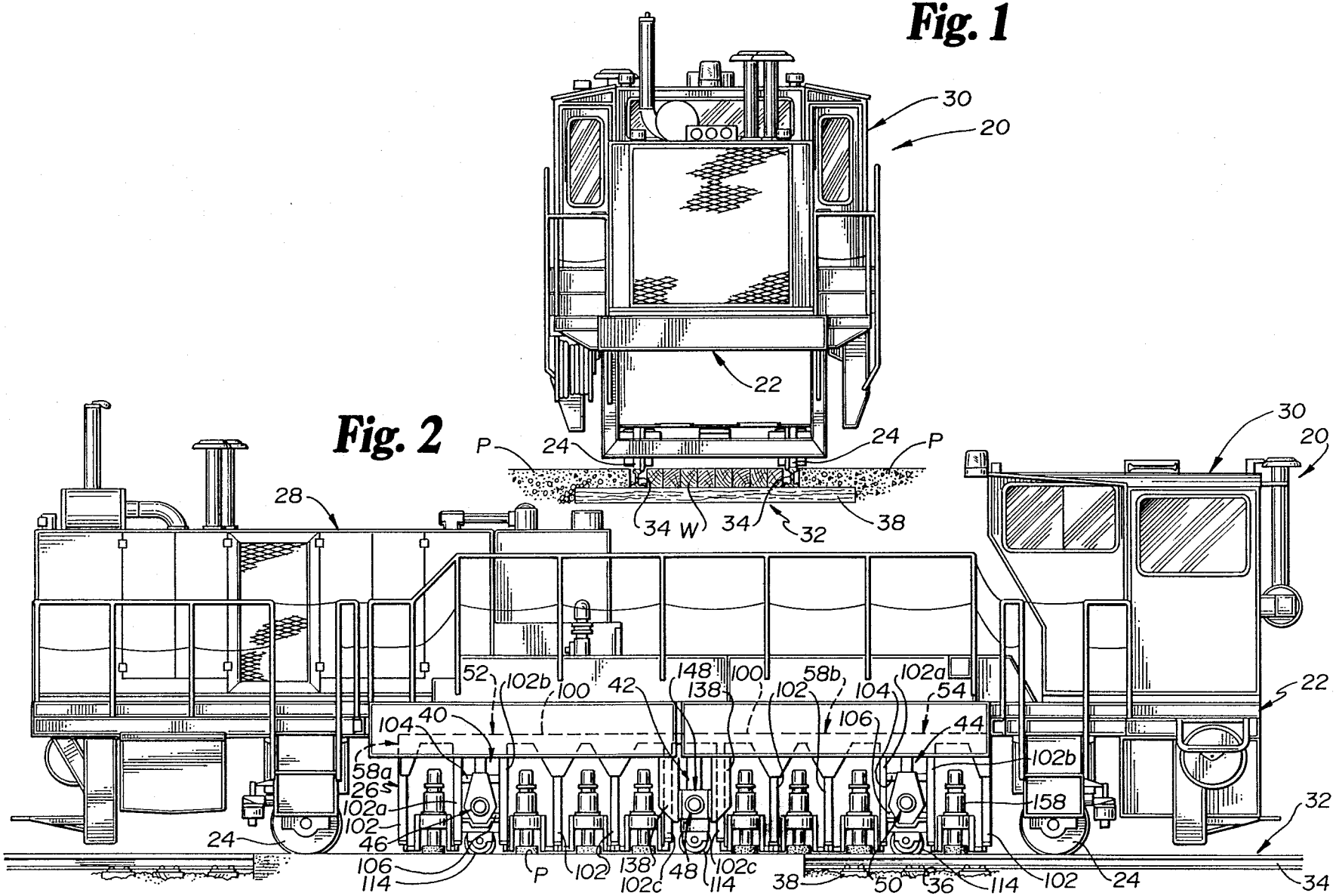
FIG. 1 is a front elevational view of a railroad grinding machine in accordance with the present invention at a road crossing.
FIG. 2 is a side elevational view of a railroad grinding machine in accordance with the present invention.

Referring to the drawings, the rail grinding machine 20 in accordance with the present invention broadly includes a railroad mounted main frame 22 supported by rail engaging wheels 24, and a grinding undercarriage 26 supported from the main frame 22. An engine compartment 28 and operator's cab 30 are positioned on the main frame 22. The grinding machine 20 is depicted mounted on railroad track 32 comprising parallel rails 34 support on road bed 36 by railroad ties 38. FIG. 1 depicts the rail grinding machine 20 at a road crossing, with the rails 34 at a level below the level of the road pavement p, and wood spacers w extending between the rails 34.

Undercarriage 26 broadly includes forward, middle, and rear vertical slide assemblies 40, 42, 44, and forward, middle, and rear horizontal slide assemblies 46, 48, 50. Undercarriage 26 is divided into a forward section 52 and a rear section 54, with the middle vertical slide assembly 42 and middle horizontal slide assembly 48 pivotally connecting the forward undercarriage section 52 and the rear undercarriage section 54. Forward section right and left side frame assemblies 56*a*, 58*a* are supported by, and extend between the forward horizontal slide assembly 46 and the middle horizontal slide assembly 48, and rear section right and left side frames 56*b*, 58*b* are supported by and extend between middle horizontal slide assembly 48 and rear horizontal slide assembly 50. The forward and rear vertical slide assemblies 40, 44, forward and rear horizontal slide assemblies 46, 50, and forward and rear side frames 56, 58 are respectively comprised of similar components that are assigned identical numerals in the drawings. Moreover, it is to be understood that although FIGS. *6a* and *6b*, and the below detailed description, are primarily directed to the forward undercarriage section 52, the structure and operation of the rear undercarriage section 54 can be ascertained from the description of the forward assemblies.

Referring to FIG. *6a*, forward vertical slide assembly 40 broadly includes vertical slide tube 64 fixedly attached to cross beam 66 of main frame 22, and vertical slide rod 68 shiftably received within vertical slide tube 64. U-shaped slide rod end bracket 70 is fixedly attached to the lower end of vertical slide rod 68. Vertical lift piston and cylinder assembly 72 extends between main frame cross beam 66 and the U-shaped bracket 70. Fore and aft generally triangular support brackets 74, 76 depend downwardly from main frame cross beam 66. Side plate 78 extends between support bracket 74, 76, and is fixedly attached to vertical slide tube 64 by weldments 80, 82.

A carriage retaining latch 84 is pivotally mounted on side plate 78 at pivot pin 79. Latch actuating piston and cylinder assembly 84 extends between a mount 88 on main frame cross beam 66 and the uppermost end of latch 84. U-shaped slide rod end bracket 70 comprises identical U-shaped plates mounted on either side of vertical slide rod 68. Latch rod 90 extends between the two plates of U-shaped bracket 70, in engageable alignment with latch 84.

Referring to FIG. *6a*, forward horizontal slide assembly 46 includes horizontal slide rod 92, and right and left horizontal slide tubes 94, 96. The horizontal slide rod 92 is pivotally coupled to vertical slide rod 68 by pivot pin 98 received through U-shaped end bracket 70. The slide tubes 94, 96 each include flange plates 99.

Right and left side frames 56, 58 each comprise an uppermost, fore and aft channel 100 and a plurality of generally equally spaced, downwardly depending grinding module support members 102. Referring to FIG. 2, a pair of upper and lower, horizontal frame elements 104, 106 extend between adjacent grinding module support members **102*a*, 102*b***. Referring to FIG. *6a*, the flange plates 99 of right and left horizontal slide tubes 94, 96 are attached to the right and left side frames 56, 58, respectively, by brackets 107 received by clevises 108 mounted on upper and lower horizontal frame elements 104, 106 of right and left side frames 56, 58. The brackets 107 are retained within clevises 108 by gimballed pivot pins 109.

Rail engaging undercarriage wheels 114 are rotatably mounted on individual hubs 116. Each hub 116 slideably supports cowling 118. The cowlings 118 are fixedly attached to respective side frames 56, 58. Shifting of each cowling 118 axially along its respective hub 116, therefore, when its associated undercarriage wheel 114 is in engagement with rail 34, will shift the respective side frames 56, 58 to which the cowling 118 is attached laterally relative to the rail 34.

Figure 3A:
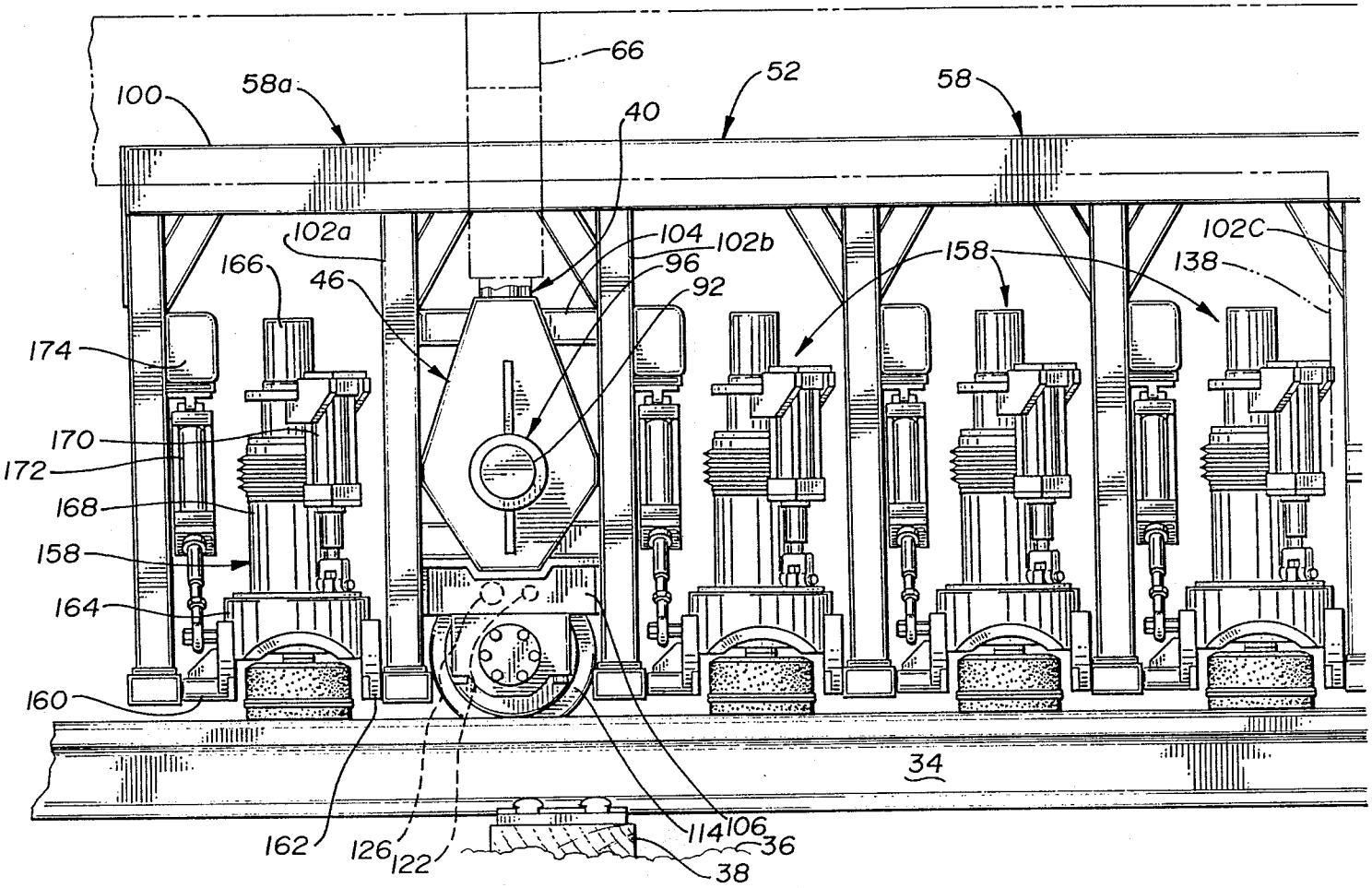
FIG. 3 is a multiple sheet drawing, FIGS. 3*a* and 3*b*, showing a left side elevational view of the grinding machine undercarriage, with the main frame indicated in phantom lines.
Figure 3B:
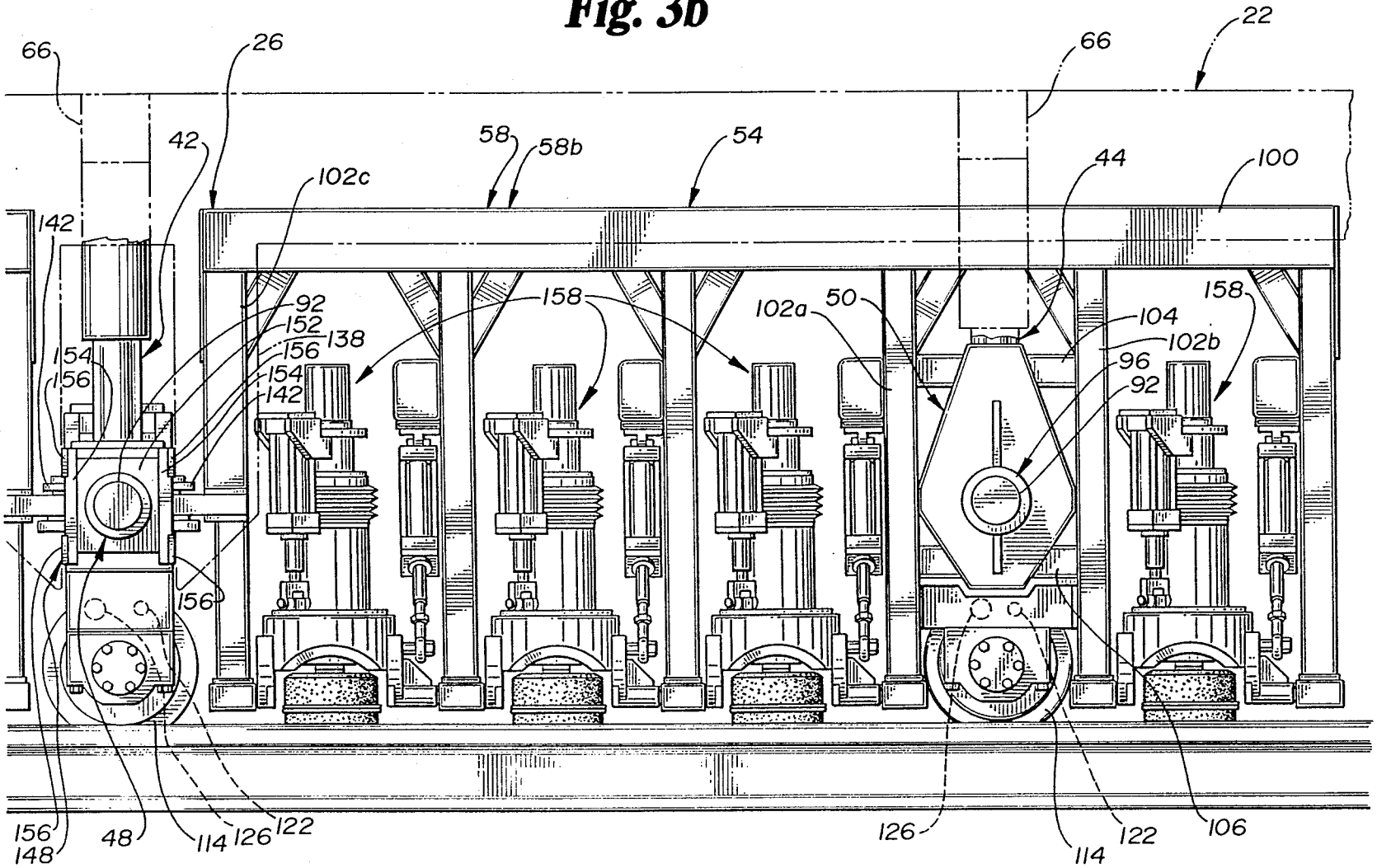
Figure 4A:
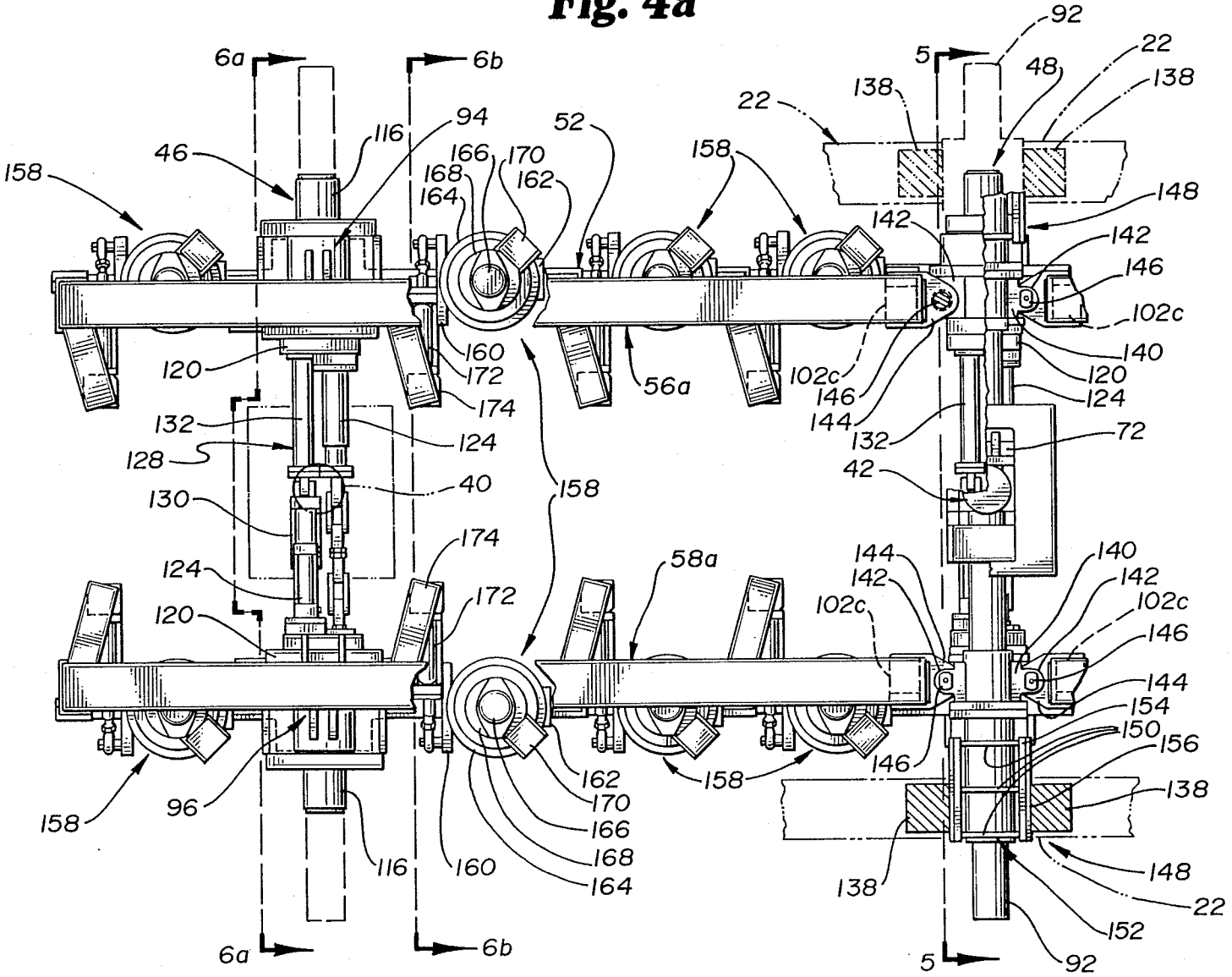
FIG. 4 is a multiple sheet drawing, FIGS. 4*a* and 4*b*, depicting a top plan view of the undercarriage of the rail grinding machine in accordance with the present invention.
Figure 4B:
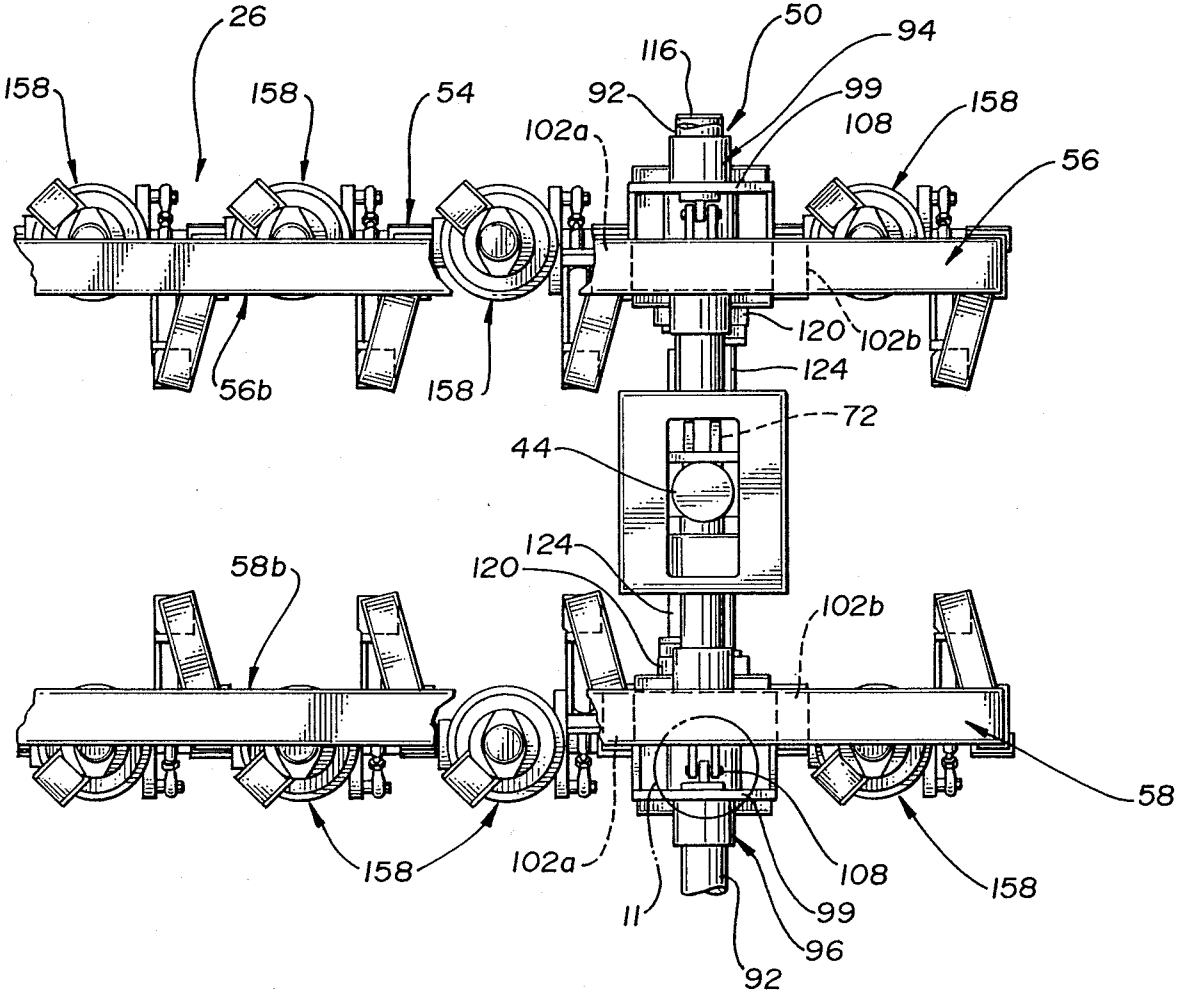

Each hub 116 is fixedly connected to a side frame shifting brace plate 120. A guide rod 122 extends from each brace plate 120. Each cowling 118 includes an aperture 119 for shiftably receiving the guide rod 122 of its associated brace plate 120. A side frame shifting piston and cylinder assembly 124 is carried by each brace plate 120. The piston 125 of each side frame shifting piston and cylinder assembly 124 is fixedly, threadably attached to its associated cowling 118, and the cylinder 126 of each side frame shifting piston and cylinder assembly 124 is fixedly carried by its associated brace plate 120. Referring to the phantom lines of FIG. 3, it will be understood that the guide rods 122 are separate from, and parallel to, the pistons 125 of the side frame shifting piston and cylinder assemblies 124.

Undercarriage spread assembly 128 extends between opposed, right and left brace plates 120. Spread assembly 128 includes spreading piston and cylinder assembly 130, and connecting rod 132. Undercarriage shifting piston and cylinder assembly 134 extends between bracket 136 mounted on the horizontal slide rod 92 and brace plate 120.

Figure 5:
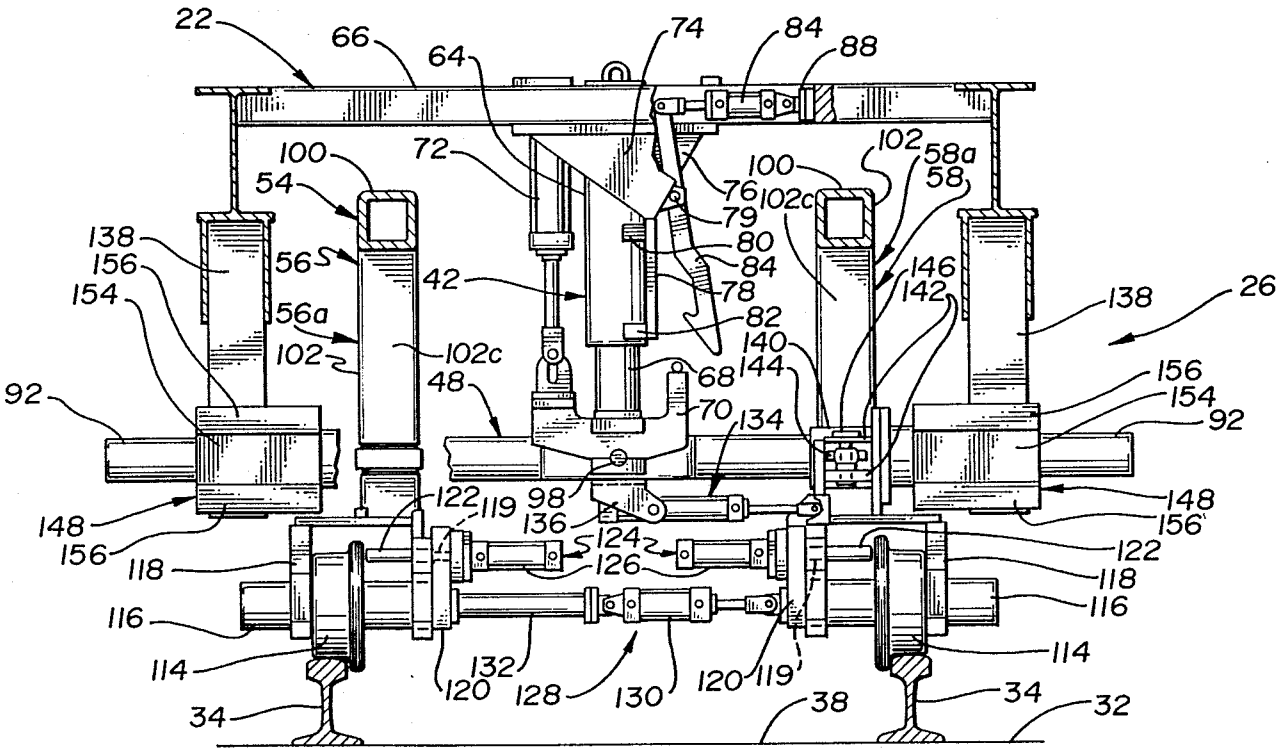
FIG. 5 is a sectional view taken along 5—5 of FIG. 4*a*, with grinding modules removed for clarity.

Referring to FIG. 5, the middle vertical slide assembly 42 and the middle horizontal slide assembly 48 are, in most respects, identical to the forward vertical slide assembly 40 and forward horizontal slide assembly 46 described above, and similar components bear identical numerals in the drawings. Note, however, that, side frames 56, 58 are connected to the middle horizontal slide rod 92 in a different manner, to be described in detail below, and that the horizontal slide rod 92 is captured at its outermost ends by brackets 138 depending downwardly from main frame 22.

More particularly, the horizontal slide rod 92 of middle horizontal slide rod 48 shiftably supports frame support collars 140. The frame support collars 140 include fore and aft, opposed, side frame receiving clevises 142. The side frame downwardly depending support members **102*c* adjacent the middle horizontal slide assembly 48 include apertured brackets 144 received within the frame support collar clevises 142 and retained by gimballed pivot pins 146. The gimballed pivot pins 146 are similar in construction to gimballed pivot pins 109**.

The horizontal slide rod 92 of the middle horizontal slide assembly 48 supports main frame, power receiving, interface assemblies 148 that are slidably received within main frame brackets 138. Each interface assembly 148 includes a plurality of radially extending mounting plates 150 carried by a mounting collar 152. Front and rear interface panels 154 are carried by the support plates 150, and include friction bearing members 156.

Individual grinding modules 158 are supported by opposed pivotal mounts 160, 162 carried by adjacent downwardly depending module support members 102 of side frames 56, 58. The grinding modules 158 include base 164 fixedly carried by the pivotal module supports 160, 162, and grinding assemblies 166 mounted for up and down shifting relative to the base 164. The grinding module base 164 includes upwardly extending support sleeve 168 through which the grinding assemblies 166 are shiftably received. A module lift piston and cylinder assembly 170 extends between the grinding module base 164 and the grinding assembly 166 of each grinding module 158. A module tilt piston and cylinder assembly 172 extends between each pivotal module support 160 and a respective support bracket 174. The support brackets 174 are mounted on side frame module support members 102.

Figure 8:
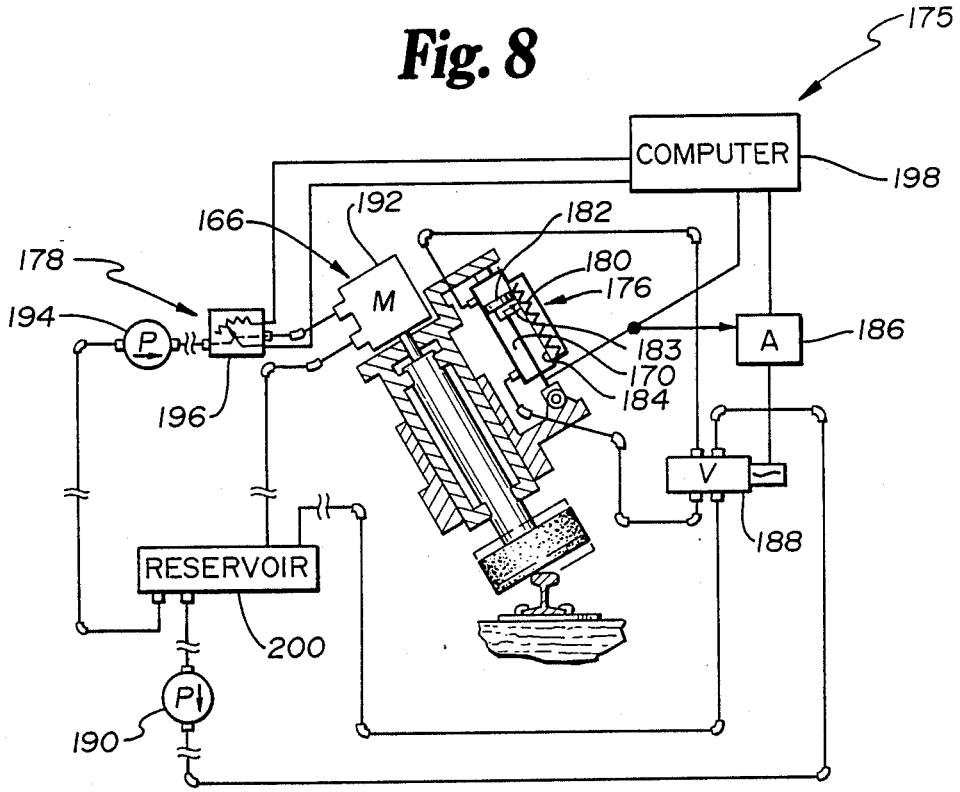
FIG. 8 is a schematic diagram depicting the grinding pressure control circuit for an individual grinding module.

A pressure control system 175 for positioning individual grinding assemblies 166 against the railhead 34 with the appropriate grinding force is depicted in schematic form in FIG. 8. The system broadly includes the grinding assembly 166, grinding assembly vertical position sensing and control system 176 and hydraulic fluid flow sensing and control system 178.

The vertical positioning sensing and control system 176 includes rheostat 180 mounted on module lift piston and cylinder assembly 170. As depicted in FIG. 8, the piston 182 of lift piston and cylinder assembly 170 includes an electrical contact 183. The position of the piston 182 inside the cylinder 184 of lift piston and cylinder assembly 170 is electrically detected by the rheostat 180. The grinding assembly vertical positioning sensing and control circuitry 176 further includes servo amp 186, flow control servo valve 188 and variable displacement pump 190.

Hydraulic fluid flow sensing and control system 178 is connected to orbit motor 192 of grinding assembly 166. The hydraulic fluid flow control system 178 includes constant displacement gear pump 194 and fluid pressure sensor 196. Computer 198 provides logic control for the pressure control system 174, and reservoir 200 provides a source of hydraulic fluid for the pressure control system 174.

Figure 12:
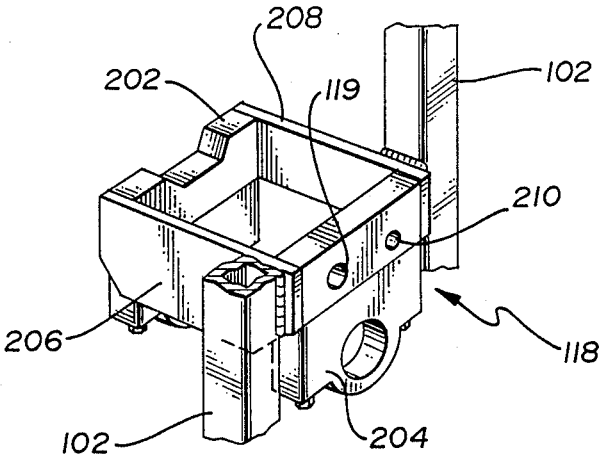
FIG. 12 is a fragmentary detailed perspective view depicting an undercarriage wheel cowling assembly with elements omitted for clarity.

Referring to FIG. 12, cowling 118 includes opposed, field side and gauge side pillow blocks 202, 204 and correcting side plates 206, 208. Threaded aperture 210 in pillow block 204 receives the piston of side frame shifting piston and cylinder assembly 124.

Figure 11:
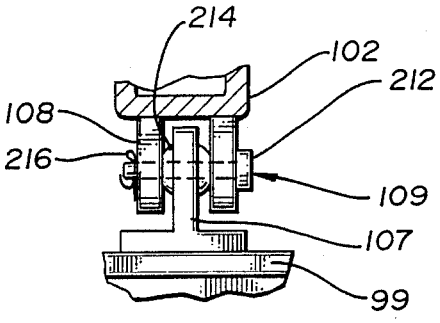
FIG. 11 is a fragmentary detailed plan view depicting a gimballed pivot pin, taken at the area encircled at 11 in FIG. 4*b;*

Referring to FIG. 11, the gimballed pivot pin 109 includes straight pin 212 received through ball joint 214. The ball joint 214 is rotatably received within bracket 107. Cotter pin 216 retains the straight pin 109 within clevis 108.

In operation, the undercarriage 26 is maintained in a raised and locked position when transporting the grinding machine 20 to a portion of railroad track to be ground. In particular, each of the vertical lift piston and cylinder assemblies 72 for the forward, middle and rear vertical slide assemblies are retracted, lifting the entire undercarriage 26 off of the rails 34. The undercarriage 26 is maintained in a raised position by engagement of latch 84 with latch rod 90 of the U-shaped brackets 70.

Upon arrival at a portion of track to be ground, latch 84 is disengaged from U-shaped bracket 70 to permit the lowering of the undercarriage 26. The piston and cylinder assemblies 130 of spread assemblies 128 are slightly retracted such that the distance between opposed undercarriage wheels 114 is less than the distance between opposed rails 34. Once the undercarriage 26 has been lowered to a position where the undercarriage wheels 34 are nearly to the level of the top of the rails 34, the piston and cylinder assembly 130 of spread assembly 128 is extended, thereby pushing the undercarriage wheels 34 outwardly until the flanges of the undercarriage wheels 114 come into contact with the gauge side of the railhead of rails 34. The piston and cylinder of piston and cylinder assembly 130 of spread assembly 128 are thereupon fixed in relative position such that the undercarriage wheels 114 are rigidly maintained in contact with the rails 34.

The above described procedure for positioning the undercarriage wheels 114 into carriage supporting contact with rails 34 assumes that the undercarriage wheels 114 are basically centered about their respective horizontal slide assemblies, and that the portion of track which the undercarriage 26 is being lowered onto is generally straight. The shift piston and cylinder assembly 134 is employed to shift the undercarriage assembly 26 into engaging alignment with the rails 34 when either of the above two assumed conditions are not met. In particular, with reference to FIGS. 5 or 6*a*, extension or retraction of wheel base shifting piston and cylinder assembly 134, while at the same time maintaining the piston and cylinder of spread piston and cylinder assembly 130 in fixed relative position, will shift undercarriage 26 to the left or right respectively along horizontal slide rod 92. Since there is an individually actuated wheel base shifting piston and cylinder assembly 130 associated with each of the forward, middle and rear horizontal slide assemblies 46, 48, 50, the undercarriage 26 can be easily manipulated for set down of the undercarriage 26 on a curved portion of the railroad track. The pivotal connection of the side frames 56, 58 to the middle horizontal slide assembly 48 permits articulation of the undercarriage 26 for positioning of the undercarriage 26 along a curved track. The gimballed pivot pins 109, 146 contribute to the flexibility of the undercarriage 26.

Figure 6A:
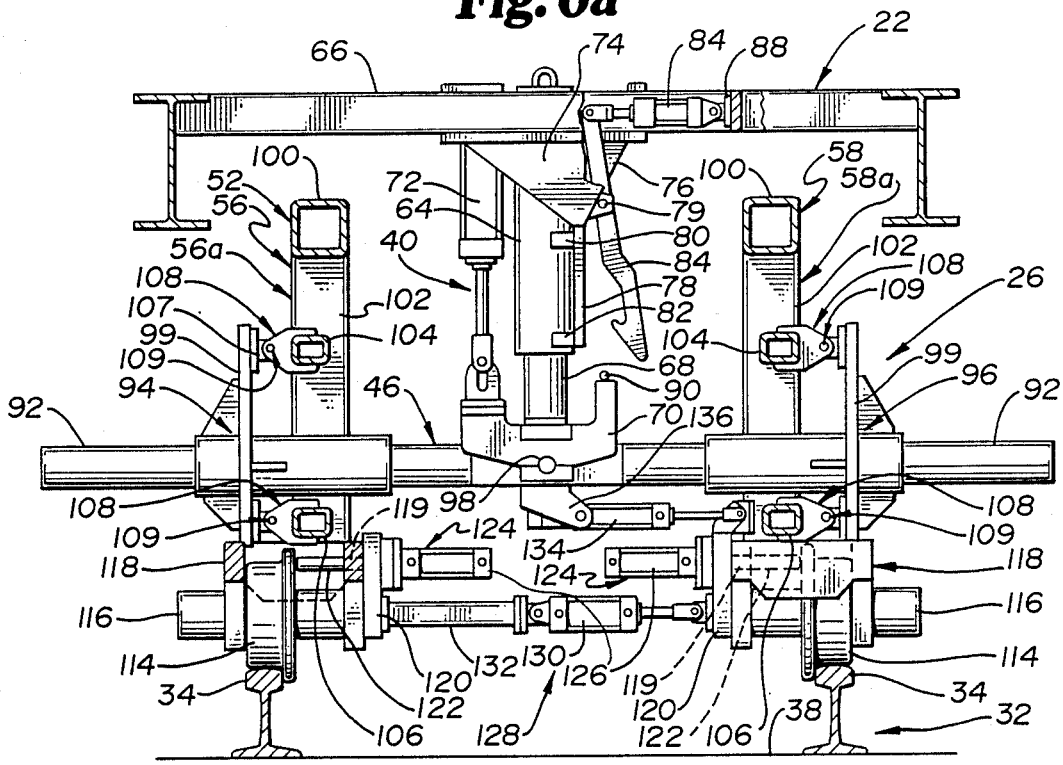
FIG. 6*a* is a sectional view taken along the line 6*a*—6*a* of FIG. 4*a* with grinding modules removed for clarity.
Figure 6B:
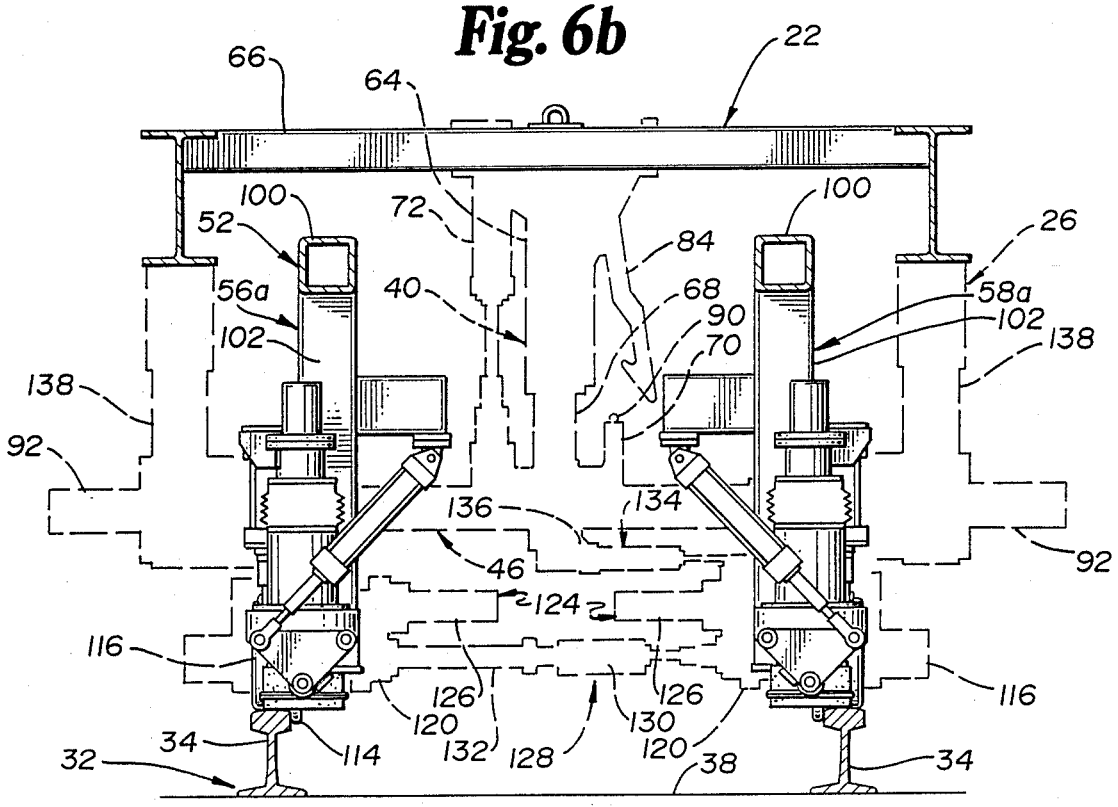
FIG. 6*b* is a sectional view along the line 6*b*—6*b* of FIG. 4*a*, with various parts indicated in phantom lines for clarity.
Figure 13:
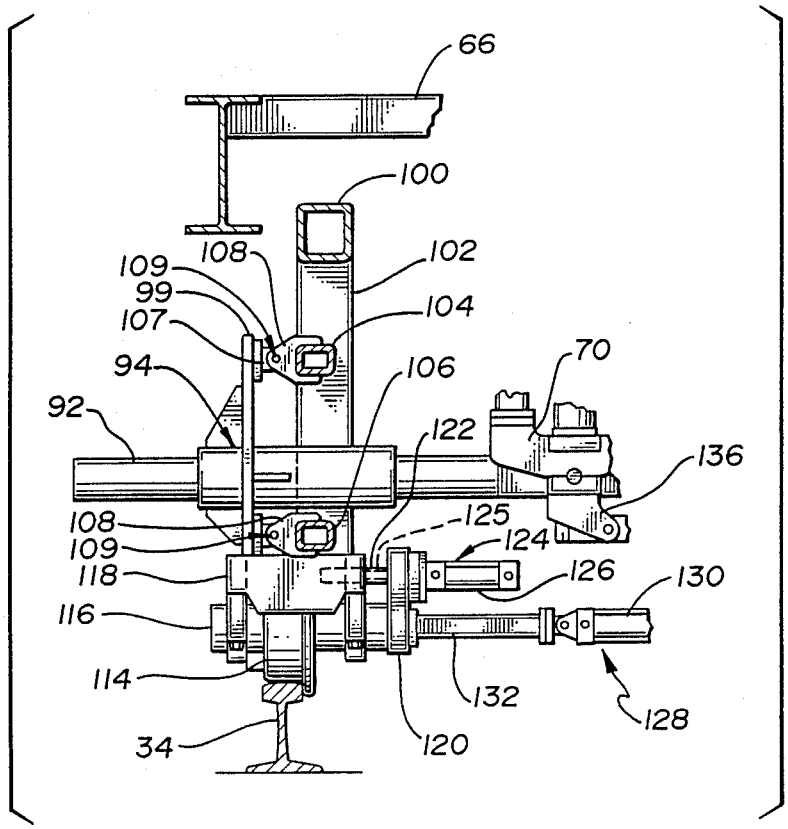
FIG. 13 is a fragmentary, detailed elevation view of FIG. 6*a* depicting an alternate position of the cowling assembly and undercarriage side frame.

Each end of each individual side frame 56, 58, together with the grinding modules 158 supported on individual side frames 56, 58 can be shifted laterally across the rails 34 by extension and retraction of the side frame shifting piston and cylinder assemblies 124. Referring to FIGS. 5 or 6*a*, with the undercarriage wheels 114 positioned in engaging contact with rails 34 by the spread assembly 128, brace plate 120 is fixed in lateral position relative to the rail 34. Extension of the associated side frame shifting piston and cylinder assembly 124 will accordingly shift cowling 118 axially along the hub 116, such as is depicted in FIG. 13. The side frames 56, 58 are fixedly attached to respective cowlings 118, and are accordingly shifted relative to the undercarriage wheel 114 and the rail 34 with which the wheel 114 is engaged.

Figure 7:
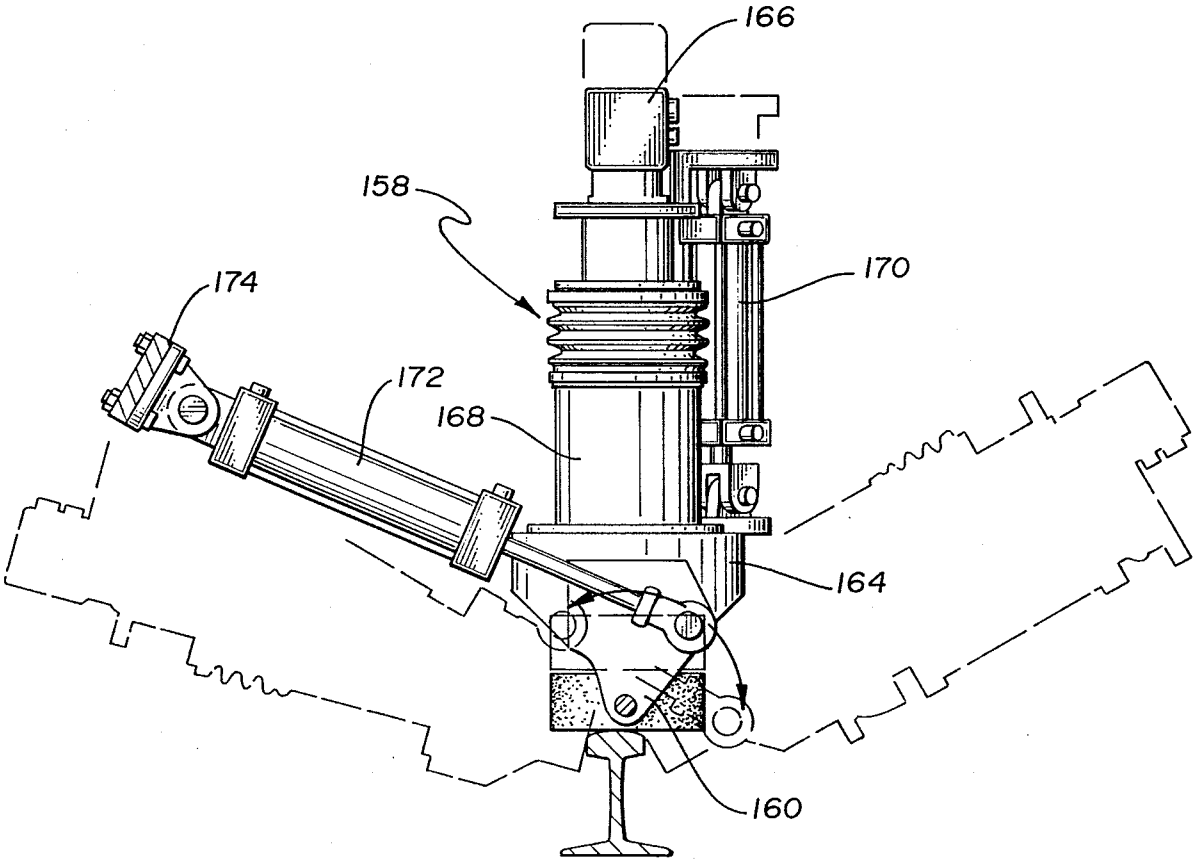
FIG. 7 is a front elevational view of a grinding module, phantom lines depicting the grinding module in various tilted orientations.

Referring to FIG. 7, the tilt angle of each individual grinding module 158 can be adjusted by the extension or retraction of module tilt piston and cylinder assembly 172. As shown in phantom lines in FIG. 7, extension of the module tilt piston and cylinder assembly 172 tilts the grinding module 158 to the right, and retraction of the tilt piston and cylinder assembly 172 tilts the grinding module 158 to the left.

The grinding stone of each grinding module 158 is brought into grinding contact with rail 34, once the undercarriage 26 is in engagement with the rails 34, by extension of the associated module lift piston and cylinder assembly 170. The amount of metal ground from a rail 34 during a single pass of the grinding stone of the grinding module 158 along the rail 34 is a function of the speed of rotation of the stone and the amount of force with which the stone is held into contact with the rail 34.

The ability to lift each individual grinding module with the piston and cylinder assembly 170, with the ability to tilt each grinding module 158 with the tilt piston and cylinder assembly 172, along with the ability to laterally shift each end of each side frame 56, 58 with the side frame shifting piston and cylinder assemblies 124, allows the individual grinding modules 158 to be brought into contact with the rail 34 in a variety of angles and alignments, permitting great flexibility in controlling the grinding operation along curves and around obstructions. It will also be appreciated that, because of the single pivot mount of each horizontal slide assembly 46, 48, 50 to its respective vertical slide assembly, the undercarriage 26 will self-align itself parallel to the plane of the track road bed, independently of the orientation of the main frame to the road bed. This is especially significant in banked curves, where the self-aligning, parallel orientation of the undercarriage 26 to the road bed permits the precise and accurate profile grinding of the railheads. The alignment of the undercarriage to the road bed independently of the orientation of the main frame 22 is maintained, notwithstanding the requirement to provide motive force to the undercarriage 26 from the main frame 22, by transmission of motive force to the undercarriage 26 solely through brackets 138. The brackets 138 provide fore and aft motive forces to the horizontal slide rod 92 of middle horizontal slide assembly 48. Up and down and right and left shifting of the power receiving interface assemblies 148 within the brackets 138 is freely allowed.

Figure 10:
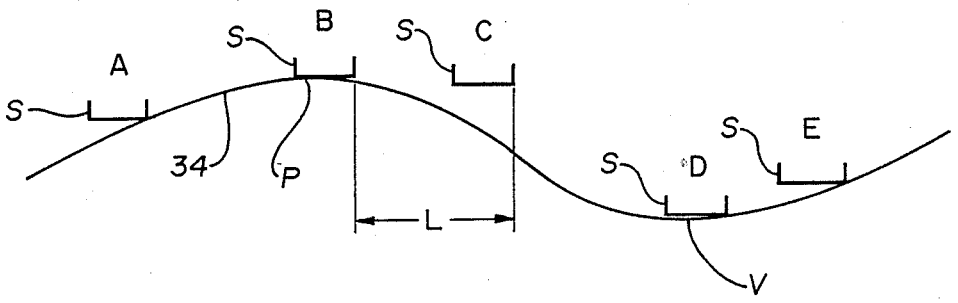
FIG. 10 is a schematic diagram of a railhead, and a single grinding stone placed along the railhead at different positions.
Figure 9:
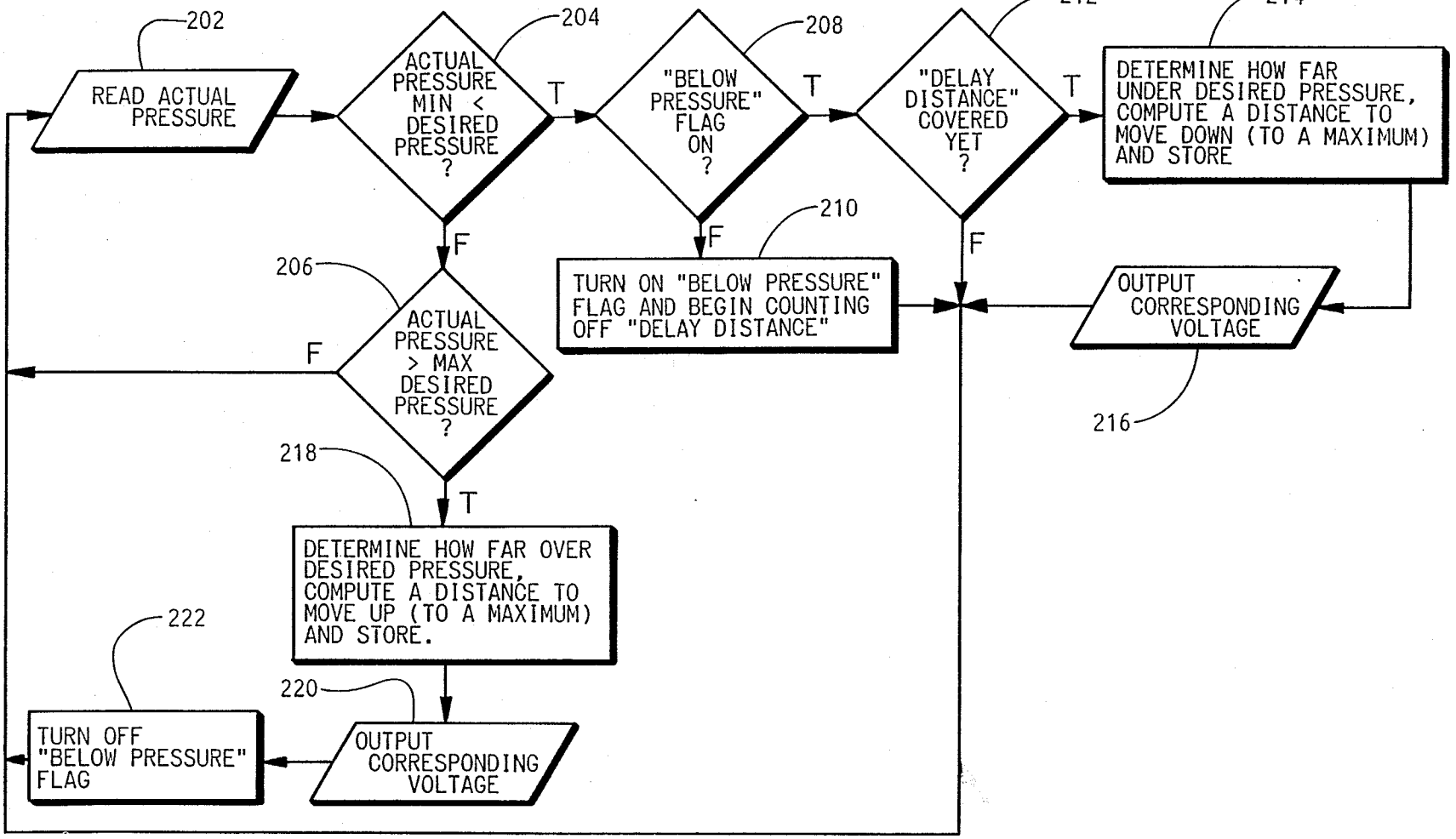
FIG. 9 is a logic diagram for the grinding pressure control circuit.

Operation of the module pressure control system 174 can be understood with reference to FIGS. 8–10. FIG. 10 schematically shows a railhead having corrugations with peaks P and valleys V along its surface. It will be appreciated by those skilled in the art that the corrugations depicted in FIG. 10 are grossly exaggerated; in practice, corrugations as small as six-hundredths of an inch can cause damage to rolling stock, and therefore must be ground smooth. The corrugations are removed by grinding metal away from the peaks in the corrugation, and by not grinding away metal in the valleys of the corrugations.

Referring to FIG. 8, the grinding stone is pushed into grinding abutment with the rail 34 by the extension of grinding module lift piston and cylinder assembly 170. The stone is rotated at a constant number of revolutions per minute by orbit motor 192. Orbit motor 192 is in turn rotated by the application of a constant flow of hydraulic fluid to the motor by constant displacement gear pump 194. As will be appreciated, maintaining a constant rate of flow of fluid through the motor 192 requires an increase in the pressure of the fluid delivered to the orbit motor 192 as the force with which the grinding stone is brought into contact with rail 34 increases.

Referring to FIG. 10, a grinding stone S is schematically depicted in a number of sequential positions as the stone S moves along a rail 34. At position A, the grinding stone is grinding on the front side of a peak P of a corrugation. As the stone S travels from point A to point B, the pressure of the hydraulic fluid delivered to orbit motor 192 to maintain a constant flow of fluid (and thereby a constant rotational speed of the orbit motor 192), will increase. The pressure of the hydraulic fluid will increase because the stone S is held at the same elevation by the module lift piston and cylinder assembly 170 as the grinding stone S is urged across the upward slope of the corrugation peak. The module lift piston and cylinder assembly 170 will maintain the elevation of the grinding stone S until a maximum acceptable pressure is exceeded. Once the maximum acceptable pressure is exceeded, the elevation of the grinding stone S is incrementally raised until the pressure drops to an acceptable level. It will be appreciated that if the pressure of the hydraulic fluid were allowed to exceed an acceptable minimum, excessive stone wear, hydraulic line failure, and general stress of the grinding system would occur.

The grinding stone S is depicted in position B as being at the top of the corrugation peak P. As the grinding stone is urged forward along the downward slope of the corrugation peak, the pressure of the hydraulic supply fluid to orbit motor 192 will drop. It is not desirable to grind in the low spot, or valley V of the corrugation, since grinding in the valley V of the corrugation will only accentuate, rather than smooth out, the corrugation. The grinding stone S is therefore held in elevation by the grinding module tilt piston and cylinder assembly 172 until the stone S has traveled a predetermined length L, and arrives at location C in FIG. 10. The length L is set to be less than the peak to peak wavelength of the corrugations. Alternatively, when grinding across a gap in the rail 34 provided by a cross over point in a switch, the distance L can be preset to a distance just longer than the length of the longest expected gap.

After the grinding stone S has traveled the predetermined length L, the grinding module tilt piston and cylinder assembly 172 will lower the stone S at a predetermined rate. The descent of the stone will continue until the stone comes into contact with the rail 34, at location D, for instance. The pressure of the hydraulic fluid supplied to orbit motor 192 will again increase as the grinding stone S travels along the rising slope of the second peak P in the corrugation. When the pressure of the hydraulic fluid reaches a predetermined maximum (at location E), the stone S will again incrementally adjust upwardly to relieve the pressure to a point below the maximum acceptable pressure.

FIG. 9 is a flow diagram that depicts the logic process executed by computer 198 to accomplish the above described positioning of the grinding stone S. At block 202, the pressure of the hydraulic fluid supplied to orbit motor 192 is determined at fluid pressure sensor 196. The actual pressure of the fluid is compared to a minimum desired pressure at block 204. If the pressure of the hydraulic fluid is not below the minimum desired pressure, program flow is directed to block 206 where the actual pressure is compared against a maximum desired fluid pressure. If the actual pressure is not greater than a predetermined maximum, program flow is again directed to block 202 where the actual pressure is again determined, and the comparison loop of the actual pressure to the minimum and maximum desired pressures is again entered.

When the actual pressure of the hydraulic fluid delivered to orbit motor 192 drops below the desired minimum pressure, program flow is directed to block 208. At block 208, the program determines whether the most recent below minimum pressure reading is the first or a subsequent below minimum pressure reading in a consecutive series of readings. In particular, program flow is directed to block 210 if the below pressure reading is the first in the series of readings, where a "below pressure" flag is set to indicate that a first below pressure reading has been made. The program, at block 210, also begins counting off a delay distance that corresponds to the distance L in FIG. 10 through which the grinding stone S is maintained in elevation before the stone is allowed to descend. Program flow is directed from block 210 back to block 202 where another pressure reading is obtained from the fluid sensor 196.

When the pressure reading provided by fluid pressure sensor 196 is a second or subsequent below pressure reading in a series of readings, the "below the pressure" flag will have already been set at block 210, and program flow will proceed from block 208 to block 212. At block 212, the program will determine whether the delay distance L has been transited by the grinding stone. If the delay distance L has not been covered by the grinding stone S, the program flow will proceed from block 212 to block 202 where another reading of the fluid pressure is obtained. When the delay distance L has in fact been covered, the program flow is directed from block 212 to block 214 where it is determined how far the most recent actual pressure reading was below the desired minimum pressure. The computer will then determine a downward distance through which the stone S should travel, depending on how far below the desired minimum pressure the most recent actual pressure reading was. The magnitude of the downward distance is greater the greater the actual pressure is below the minimum desired pressure. Program flow is next directed from block 214 to block 216 where the computer outputs a signal to servo amp 186 which results in servo valve 188 being operated to lower the grinding module lift piston and cylinder assembly 170.

Program flow is next redirected from block 216 to block 202 where another pressure reading of the hydraulic fluid delivered to the orbit motor 192 is taken. When the pressure of the hydraulic fluid is above the predetermined desired minimum pressure, but is also above the predetermined maximum pressure, the program flow is directed from block 204 to block 206, and subsequently to block 218. At block 218 the program determines how far above the desired maximum pressure the actual pressure is and computes a distance through which the grinding stone needs to be lifted to relieve the pressure. The magnitude of the distance the stone is to be lifted becomes greater as the amount the actual pressure is above the maximum desired pressure becomes greater. Program flow is next directed to block 220 where a grinding module lift signal is provided to servo amp 186, resulting in the actuation of servo valve 188 to raise the grinding module lift piston and cylinder assembly 170. The program flow is next directed from block 220 to block 222 where the "below pressure" flag previously set at program block 210 is turned off. The program then cycles again to block 202 where yet another reading of pressure of the hydraulic fluid delivered orbit motor 192 is taken, and the logic cycle begins again.

I claim:

1. A railroad grinding machine, having a main frame supported along the rails of a railroad track and an undercarriage for supporting a plurality of grinding modules, said undercarriage comprising:

a pair of generally parallel, opposed side frames generally aligned with said railroad rails;

vertical suspension means for selectively lowering and raising said side frames from said main frame;

horizontal suspension means operably coupled to said vertical suspension means for selectively shifting said side frames from side to side across said rails independently of said main frame; and side frame shifting means for selectively shifting sad side frames from side to side across said rails independently from each other.

2. A railroad grinding machine, having a main frame supported along the rails of a railroad track by rail engaging main frame wheels, and an undercarriage depending from said main frame and supportable along said rails by rail engaging undercarriage wheels, said undercarriage comprising:

a first side frame operably carried by said main frame having a first end and an opposed second end, said first side frame being generally aligned along the longitudinal axis of one of said rails;

means for shiftably mounting said first side frame relative to said undercarriage wheels; and at least one grinding module operable coupled to said first side frame for selectively grinding said one rail, said means for shiftably mounting said first side frame relative to said undercarriage wheels comprising first side frame shifting means operably coupled to said first side frame first ned for selectively laterally shifting said first side frame first end relative to said undercarriage wheels independently of said second end and transversely to the longitudinal axis of said one rail.

3. A railroad grinding machine as claimed in claim 2 including a second side frame shifting means operably coupled to said main frame and the second end of said first side frame for laterally shifting said first side frame second end relative to said undercarriage wheels independently of the first end of said first side frame end and transversely to the longitudinal axis of said one rail.

4. A railroad grinding machine having a main frame supported along the rails of a railroad track, and an undercarriage depending from said main frame, said undercarriage comprising:

a first side frame operably carried by said main frame having a first end and an opposed second end, said first side frame being generally aligned along the longitudinal axis of one of said rails;

at least one grinding module operable coupled to said first side frame for selectively grinding said one rail;

first side frame shifting means operably coupled to said first side frame first end for selectively laterally shifting said first side frame first end transversely to the longitudinal axis of said one rail; and a second side frame shifting means operably coupled to said main frame and the second end of said first side frame for laterally shifting said first side frame second end independently of the first end of said first side frame transversely to the longitudinal axis of said one rail, said first and second side frame shifting means each comprising a shiftable side frame mount and a side frame shift actuator, said side frame mount comprising a bar member operably coupled to said main frame and a slidable clamp operably, fixedly coupled to said first side frame and shiftably carried by said bar member.

5. A railroad grinding machine as claimed in claim 4, said shift actuator comprising an extensible actuator piston and cylinder assembly.

6. A railroad grinding machine as claimed in claim 2, said grinding machine including a grinding module vertical positioning means for raising and lowering said grinding module relative to said undercarriage.

7. A railroad grinding machine as claimed in claim 2, said grinding module including a grinding head abuttingly engageable with said one rail in grinding relationship, said apparatus including a grinding module pivot means for pivoting said grinding module about said one rail.

8. A railroad grinding machine as claimed in claim 2, said machine including an undercarriage vertical suspension means for raising and lowering said undercarriage relative to said main frame.

9. A railroad grinding machine as claimed in claim 2, said undercarriage including a second side frame generally aligned along the longitudinal axis of the other one of said rails and at least one grinding module operably coupled to said second side frame for selectively grinding said other rail.

10. A railroad grinding machine as claimed in claim 9, said undercarriage including a spreader means operably coupling said first side frame to said second side frame for selectively shifting said first side frame and said second side frame toward and away from each other.

11. A rail grinding machine having a main frame supported along the rails of a railroad track, and an undercarriage depending from said main frame, said undercarriage comprising:

a first side frame operably carried by said main frame having a first end and an opposed second end, said first side frame being generally aligned along the longitudinal axis of one of said rails;

at least one grinding module operably coupled to said first side frame for selectively grinding said one rail;

first side frame shifting means operably coupled to said first side frame first end for selectively laterally shifting said first side frame first end independently of said second end transversely to the longitudinal axis of said one rail;

a spreader means operably coupling said first side frame to said second side frame for selectively shifting said first side frame and said second side frame toward and away from each other; and shift means operably coupling said first and second side frames to said undercarriage for laterally shifting said first and second side frames in unison transversely to said rails.

12. A railroad grinding machine as claimed in claim 2, including an additional side frame generally aligned along the longitudinal axis of said one of said rails and bearing a first end and an opposed second end, said additional side frame first end being operably, pivotally coupled to said first side frame first end.

13. A railroad grinding machine as claimed in claim 12, including an additional side frame shifting means operably coupled to said main frame and said additional side frame second end for laterally shifting said additional side frame second end transversely to the longitudinal axis of said one rail.

14. A railroad grinding machine, having a main frame supported along the rails of a railroad track and an articulated undercarriage depending from said main frame, said undercarriage including:

a forward undercarriage section including wheels adapted for engaging said tracking;

a rear undercarriage section including wheels adapted for engaging said track;

means operably pivotally coupling said forward and rear undercarriage sections; and means operably coupling said main frame and said undercarriage for selectively raising and lowering said undercarriage between lowered, rail engaging and raised, rail clearing positions, said means for raising and lowering said undercarriage including means for pivotally suspending said undercarriage from said main frame whereby said undercarriage is adapted for conforming to the plane defined by said railroad tracks independent of the positioning of said main frame on said railroad tracks.

15. The invention as claimed in claim 14 including means operably coupling said main frame and said undercarriage for selectively, laterally shifting said undercarriage transversely to the longitudinal axis of said railroad track, independent of the position of said main frame on said railroad track.

16. The invention as claimed in claim 15, said forward and aft undercarriage section each including a right side frame and an opposed left side frame, each of said side frames being generally aligned along the longitudinal axis of a corresponding one of said rails, said means for laterally shifting said undercarriage including means operably coupled to each of said right and left side frames for transversely shifting each of aid opposed right and left side frames transversely across the corresponding one of said rails independently of the side frame opposed to the side frame being shifted.

17. The invention as claimed in claim 16, said means for laterally shifting said undercarriage including means for shifting said right and left side frames in unison.

18. The invention as claimed in claim 14, including means operably, slidably coupling said main frame and said undercarriage for transmitting motive power from said main frame to said undercarriage whereby said undercarriage is pivotable in relationship to said main frame while being urged along aid railroad track by said main frame.

19. The invention as claimed in claim 18, said means for slidably coupling said main frame and said undercarriage comprising a bracket depending from said main frame and a rod operably coupled to said undercarriage slidably received within said bracket.

20. A railroad grinding machine having a main frame supported along the rails of a railroad track, comprising:

a grinding module including a grinding head for selectively abutting one of said rails in grinding contact;

motive means operably coupled to said grinding module for powering said grinding head at a constant speed;

grinding module positioning means operably coupled to said grinding module for urging said grinding head against said one rail at a grinding pressure;

pressure sensing means operably coupled to said motive means for operably sensing said grinding pressure;

vertical position sensing means operably coupled to said grinding module for determining the vertical position of said grinding module; and means operably coupled to said grinding module positioning means, said pressure sensing means, and said vertical position sensing means, for controlling the position of said grinding module.

21. The invention as claimed in claim 20 said means for controlling he position of said grinding module including means for comparing said grinding pressure to a predetermined value, and means for urging said grinding head towards or away from said rail to increase or decrease said grinding pressure to maintain said grinding pressure at said predetermined value.

22. The invention as claimed in claim 21, including means for delaying the urging of said grinding head towards said rail to increase said grinding pressure for a predetermined time after said grinding pressure is determined to be less than said predetermined value.

23. A method for grinding a railroad track rail, comprising:

operating a grinding means at a first orientation in grinding contact with said rail while moving said grinding means along said rail;

monitoring the grinding power expended by said grinding means;

determining the vertical position of said grinding module when said grinding module is in said first orientation;

shifting said grinding means to a second orientation along a first path of travel away from said rail when said grinding power exceeds a predetermined maximum;

maintaining said grinding means in said second orientation for a predetermined distance along said rail when said grinding power is less than a predetermined minimum; and returning said grinding means to said first orientation along a second path of travel towards said rail when said grinding means has traveled said predetermined distance along said rail.

24. The method as claimed in claim 23, said grinding means comprising a grinding wheel operated at a constant rotational speed, said step of monitoring said grinding power comprising monitoring the operating power required to operate said grinding wheel at said constant rotational speed.

25. The method as claimed in claim 24, said grinding wheel being rotated at said constant rotational speed by a constant flow hydraulic fluid motive system, said step of monitoring said operating power comprising monitoring the fluid pressure within said constant flow hydraulic fluid motive system.

26. The method as claimed in claim 23, said step of shifting said grinding means to said second orientation including the step of computing the distance to shift said grinding means to said second orientation along said first path of travel as a function of how much said grinding power exceeds said predetermined maximum.

27. A railroad grinding machine, having a main frame supported along the rails of a railroad track and an articulated undercarriage depending from said main frame, said undercarriage including:

a forward undercarriage section including wheels adapted for engaging said track;

a rear undercarriage section including wheels adapted for engaging said track;

means operably pivotally coupling said forward and rear undercarriage section;

means operably coupling said main frame and said undercarriage for selectively raising and lowering said undercarriage between lowered, rail engaging and raised, rail clearing positions; and means operably coupling said main frame and said undercarriage for selectively, laterally shifting said undercarriage transversely to the longitudinal axis of said railroad track, independent of the position of said main frame on said railroad track.

28. The invention as claimed in claim 27, said forward and aft undercarriage sections each including a right side frame and an opposed left side frame, each of said side frames being generally aligned along the longitudinal axis of a corresponding one of said rails, said means for laterally shifting said undercarriage including means operably coupled to each of said right and left side frames for transversely shifting each of said opposed right and left side frames transversely across the corresponding one of said rails independently of the side frame opposed to the side frame being shifted.

29. The invention as claimed in claim 28, said means for laterally shifting said undercarriage including means for shifting said right and left side frames in unison.

30. A railroad grinding machine for grinding the rails of a railroad track comprising:

a main frame supported along said rails by main frame rail engaging wheels;

an undercarriage including undercarriage wheels adapted for engaging said track and supporting said undercarriage along said tracks; and means for pivotally suspending said undercarriage from said main frame whereby said undercarriage is adapted for conforming to the plane defined by said railroad tracks independent of the positioning of said main frame on said railroad tracks.

31. The invention as claimed in claim 30, said undercarriage including a forward undercarriage section, a rear undercarriage section, and means operably pivotally coupling said forward and rear undercarriage sections.

32. The invention as claimed in claim 31, including means operably, slidably coupling said main frame and said undercarriage for transmitting motive power from said main frame to said undercarriage whereby said undercarriage is pivotable in relationship to said main frame while being urged along said railroad track by said main frame.

33. The invention as claimed in claim 32, said means for slidably coupling said main frame and said undercarriage comprising a bracket depending from said main frame and a rod operably coupled to said undercarriage slidably received within said bracket.

34. The invention as claimed in claim 30 including means for selectively raising and lowering said undercarriage between lowered, rail engaging and raised, rail clearing positions.

35. The invention as claimed in claim 30, including means operably coupling said main frame and said undercarriage for selectively, laterally shifting said undercarriage transversely to the longitudinal axis of said railroad track, independent of the position of said main frame on said railroad track.

36. The invention as claimed in claim 35, said undercarriage including a right side frame and an opposed left side frame, each of said side frames being generally aligned along the longitudinal axis of a corresponding one of said rails, said means for laterally shifting said undercarriage including means operably coupled to said right and left side frame for transversely shifting either of said right and left side frames transversely across the corresponding one of said rails independently of the other side frame.

37. The invention as claimed in claim 36, said means for laterally shifting said undercarriage including means for shifting said right and left side frames in unison.

38. The invention as claimed in claim 30, said means for pivotally suspending said undercarriage comprising an extensible, generally vertical slide assembly depending from said main frame, and a generally horizontal support member operably pivotally coupled to said slide assembly.

39. The invention as claimed in claim 38, said undercarriage being shiftably supported along said horizontal support member.

40. The invention as claimed in claim 39, including lift means for selectively raising and lowering said horizontal support member whereby said undercarriage is shiftable between a lowered rail engaging position and a raised, rail clearing position.

41. The invention as claimed in claim 40, said lift means comprising means for selectively retracting and extending said vertical slide assembly.

* * * * *

UNITED STATES PATENT AND TRADEMARK OFFICE

CERTIFICATE OF CORRECTION

PATENT NO. : 4,829,723

DATED : May 16, 1989

INVENTOR(S) : Timothy Bad Heart Bull et al.

It is certified that error appears in the above-identified patent and that said Letters Patent is hereby corrected as shown below:

Column 10, line 7, delete the word "ned" and substitute therefor --end--.

Column 10, line 32, after the word "end" add the words --independently of said second end--.

Column 11, line 49, delete the word "tracking" and substitute therefor --track--.

Column 12, line 10, delete the word "aid" and substitute therefor --said--.

Column 14, line 44, delete the word "frame" and substitute therefor --frames--.

Signed and Sealed this

Thirtieth Day of January, 1990

*Attest:*

JEFFREY M. SAMUELS

*Attesting Officer* *Acting Commissioner of Patents and Trademarks*